US008746468B2

(12) United States Patent
Poulokefalos

(10) Patent No.: US 8,746,468 B2
(45) Date of Patent: Jun. 10, 2014

(54) MERCHANDISE DISPLAY AND PUSHER DEVICE

(75) Inventor: Dimitris Poulokefalos, South Barrington, IL (US)

(73) Assignee: American Gasket Technologies, Inc., Addison, IL (US)

( * ) Notice: Subject to any disclaimer, the term of this patent is extended or adjusted under 35 U.S.C. 154(b) by 147 days.

(21) Appl. No.: 12/934,239

(22) PCT Filed: Mar. 20, 2009

(86) PCT No.: PCT/US2009/037873

§ 371 (c)(1),
(2), (4) Date: Sep. 23, 2010

(87) PCT Pub. No.: WO2009/117699

PCT Pub. Date: Sep. 24, 2009

(65) Prior Publication Data

US 2011/0174750 A1 Jul. 21, 2011

Related U.S. Application Data

(60) Provisional application No. 61/070,363, filed on Mar. 21, 2008.

(51) Int. Cl.
*A47F 1/00* (2006.01)

(52) U.S. Cl.
USPC ..... 211/59.3

(58) Field of Classification Search
USPC ..... 211/59.3, 51, 59.4, 184, 175, 59.2
See application file for complete search history.

(56) References Cited

U.S. PATENT DOCUMENTS

| | | | | |
|---|---|---|---|---|
| 3,083,067 | A | 3/1963 | Vos et al. | |
| 3,815,519 | A | 6/1974 | Meyer | |
| 4,712,694 | A | 12/1987 | Breslow | |
| 4,724,968 | A | 2/1988 | Wombacher | |
| 4,830,201 | A | 5/1989 | Breslow | |
| 5,190,186 | A | 3/1993 | Yablans et al. | |
| 5,265,738 | A | 11/1993 | Yablans et al. | |
| 5,265,739 | A | 11/1993 | Price, Jr. et al. | |
| 5,437,116 | A | 8/1995 | Hardy | |
| 5,562,217 | A | 10/1996 | Salveson et al. | |
| 5,634,564 | A | 6/1997 | Spamer et al. | |
| 5,673,801 | A | 10/1997 | Markson | |
| 5,746,328 | A | 5/1998 | Beeler et al. | |
| 5,970,887 | A | 10/1999 | Hardy | |
| 6,041,720 | A | 3/2000 | Hardy | |
| 6,047,647 | A * | 4/2000 | Laraia, Jr. | 108/61 |

(Continued)

*Primary Examiner* — Jonathan Liu
*Assistant Examiner* — Stanton L Krycinski
(74) *Attorney, Agent, or Firm* — Vangelis Economou; Economou IP Law

(57) ABSTRACT

Pushers for displaying merchandise forward on a shelf including shelf attachments including base extending perpendicularly and longitudinally along the end and parallel to shelf edge, a front attachment wall extending essentially vertically from the base disposed at a base front edge, the front attachment wall including base engagement teeth protruding essentially horizontally from the front attachment wall toward the shelf, and an upraised ridge region removed from the vertically extending front attachment wall in the second direction that is offset from the plane of the base, a divider portion including a divider block and an essentially planar divider extending outwardly from the divider block; pusher track having a top surface and two rails, and at least one track tooth disposed at a longitudinal end of the track, the at least one track tooth providing engagement from the track tooth and base engagement teeth; and a resilient pusher member.

11 Claims, 8 Drawing Sheets

(56) References Cited

U.S. PATENT DOCUMENTS

| | | | | |
|---|---|---|---|---|
| 6,082,557 | A | 7/2000 | Leahy | |
| 6,142,317 | A | 11/2000 | Merl | |
| 6,234,328 | B1 | 5/2001 | Mason | |
| 6,305,559 | B1 | 10/2001 | Hardy | |
| 6,382,431 | B1 | 5/2002 | Burke | |
| 6,405,880 | B1 | 6/2002 | Webb | |
| 6,527,127 | B2 | 3/2003 | Dumontet | |
| 6,533,131 | B2 | 3/2003 | Bada | |
| 6,607,083 | B1 | 8/2003 | Webb | |
| 6,655,536 | B2 | 12/2003 | Jo et al. | |
| D485,699 | S | 1/2004 | Mueller et al. | |
| 6,769,552 | B1 * | 8/2004 | Thalenfeld | 211/59.3 |
| 6,783,012 | B2 | 8/2004 | Webb | |
| 6,824,009 | B2 | 11/2004 | Hardy | |
| 6,932,226 | B2 | 8/2005 | Hardy | |
| 6,964,235 | B2 | 11/2005 | Hardy | |
| 7,093,546 | B2 | 8/2006 | Hardy | |
| 7,150,365 | B2 | 12/2006 | Hardy et al. | |
| 7,152,536 | B2 | 12/2006 | Hardy | |
| 7,182,209 | B2 | 2/2007 | Squitieri | |
| 7,216,770 | B2 | 5/2007 | Mueller et al. | |
| 7,299,934 | B2 | 11/2007 | Hardy et al. | |
| 2004/0050811 | A1 * | 3/2004 | Leahy et al. | 211/134 |
| 2004/0140278 | A1 | 7/2004 | Mueller et al. | |
| 2004/0140279 | A1 | 7/2004 | Mueller et al. | |
| 2005/0077260 | A1 * | 4/2005 | Mueller et al. | 211/59.3 |
| 2005/0092703 | A1 | 5/2005 | Mueller et al. | |
| 2005/0161420 | A1 | 7/2005 | Hardy et al. | |
| 2005/0166806 | A1 | 8/2005 | Hardy | |
| 2006/0021957 | A1 | 2/2006 | Hardy | |
| 2006/0049122 | A1 | 3/2006 | Mueller et al. | |
| 2006/0076301 | A1 | 4/2006 | Caterinacci et al. | |
| 2007/0090068 | A1 | 4/2007 | Hardy | |
| 2007/0158281 | A1 | 7/2007 | Hardy | |
| 2007/0193971 | A1 | 8/2007 | Hardy et al. | |
| 2007/0267367 | A1 | 11/2007 | Mueller et al. | |

* cited by examiner

MERCHANDISE DISPLAY AND PUSHER DEVICE

CROSS-REFERENCE TO RELATED APPLICATIONS

This is a national phase of PCT/US2009/037873, filed on 20 Mar. 2009 and published as WO2009/117699, which is a PCT application relying for priority on Provisional Application Ser. No. 61/070,363 filed on Mar. 21, 2008.

BACKGROUND OF THE INVENTION

1. Field of the Invention

This invention is relates generally to a merchandise display system and a pusher device utilized in the system, and more specifically relates to a system that provides for greater flexibility and efficiency in use of the merchandising shelf space.

2. Background Art

Merchandising systems utilizing a series of dividers and a pusher that biases the merchandise packages along a track between the dividers so that the merchandise is brought forward to the front edge of the shelf where it will be most visible to the prospective purchaser. An early example of these merchandising systems is described in U.S. Pat. No. 3,083,067 to Vos et al. It utilized a pusher system having a helical spring that pulls the pusher toward the front edge of the shelf to which the device is attached. Products are pushed by the pusher toward the front edge and when one items is removed, the spring pulls the pusher forward and that pushes the remaining products in the tray toward the front edge.

Improvements of this rudimentary device in the aforementioned U.S. Pat. No. 3,083,067 included providing a flattened roll spring that is attached to the back face of the pusher, the end of the spring being attached to a front of the tray or channel. Additionally, the width of the tracks or chutes along which the merchandise items are pushed by the pusher may be made to vary so as to accommodate merchandise packages of various sizes. This is done by providing means to move the vertically standing dividers that define the tracks or chutes laterally relative to the front edge of the shelf, so that the distance between the dividers can be just slightly wider than the width of the merchandising items that are in that track. Adjoining tracks may have different widths to accommodate different sized products, so that when the products that are being carried on that shelf are rotated, the widths of the tracks can be adjusted to accommodate the sizes of the new products.

When the products from a specific track are depleted, it is not desirable for the dividers to be unsupported, because they may be liable to tipping over and falling onto the shelf, making for an unpreventable display. Accordingly, various methods of supporting the dividers while retaining the predetermined lateral spacing between the dividers have been proposed. Included in these are U.S. Pat. Nos. 5,190,186 and 5,265,739 to Yablans et al. which describe and illustrate a plurality of slots at the front edge and the back of a track into which planar dividers are inserted. The slots are adjacent each other and evenly spaced so that transposing the two edges of the dividers. Additionally, a pusher is mounted to run a long a track, the pusher having a coil spring, and ends of the track having projections thereon that also fit within the slots so to position and support the tracks on the shelf, and defining the walls of the chute or track along which the merchandising products are pushed by the pusher. The track may extend along the complete width of the chute, but need not do so.

Additional improvements are found in later issued patents and in published applications, for example, upwardly directed projections evenly spaced to provide adjustable placement of the dividers which can be placed along the bottom of a supporting surface, such as in U.S. Pat. No. 6,234,328 to Mason, or projections in the form of teeth extending from one wall or both walls of the front edge and back of the shelf, as in U.S. Pat. No. 6,082,557 to Leahy. Disposition of the teeth in different portions of the support structure, for example, in the systems shown and described in U.S. Pat. Nos. 6,041,720 and 7,216,770 allow for some variability in the connections and support structure of the tracks relative to the shelf or to a support strip along the front portion of the shelf.

What none of the prior art shelf merchandising pusher systems do lack and what is needed, however, is a system and pusher that makes best use of the available shelf space, which can provide added flexibility to the adjustable placement of both the dividers and the tracks, while making the adjustability of the tracks and dividers much easier and more efficient while not detracting from the aesthetic appearance or the working of the system.

SUMMARY OF THE INVENTION

Accordingly, what is described and claimed herein is a merchandising system having features that provides for easy and efficient track width adjustment while simultaneously providing a robust and better and more efficient shelf organizer and pusher assembly system for providing front forward items for purchase. A pusher merchandising system adapted to be attached to a shelf for displaying merchandise items at a forward edge of the shelf comprises a shelf attachment portion that is shaped and configured to attach to a forward edge of a merchandise shelf, the shelf attachment portion including a base extending essentially in a plane defined by a first direction essentially parallel to the shelf surface and perpendicularly to a front shelf edge and by a second direction extending essentially perpendicular to the shelf surface when the shelf attachment portion is attached to the shelf for operation, the base having a front attachment wall extending essentially vertically from the plane of the base and being configured to be disposed at a proximal edge of said base closest to the forward edge of the shelf when the shelf attachment portion is attached to the shelf, the front attachment wall including base engagement teeth protruding essentially horizontally from the front attachment wall in the first direction, an intermediate base section of the base connected to the front attachment wall, and an upraised plateau removed from the vertically extending front attachment wall and extending essentially in the second direction and raised above the intermediate base section; a divider portion including a divider block having a proximal end and a distal end, at least one surface extending horizontally substantially between the proximal and distal ends, an essentially planar divider extending outwardly from the divider block essentially perpendicularly to the divider block one surface and an attachment means disposed at said proximal end adapted for connection to said attachment portion; and an elongate pusher track, the pusher track having a longitudinally extending base, a proximal end and a distal end defining a track direction, a pusher surface extending substantially between the proximal and distal ends, the pusher surface extending laterally beyond the base to define a cantilevered extension at each lateral edge, and an attachment means disposed at the proximal end for connection to the attachment portion; and a pusher having a connecting base and a facing pushing surface extending therefrom, the connecting base including a pusher base connection mechanism for cooperation with the cantilevered extension of said pusher track to maintain the pushing face oriented in a direction perpendicular to the track direction.

In preferred configurations, the engagement portion teeth are triangular for engaging similarly shaped but oppositely oriented teeth on the portions attached to the attachment portion, and may be on a strip that is separate from the attachment portion, and is attachable thereto by means of a dovetail slot allowing the strip to be retained in the attachment portion by sliding the dovetail into a like shaped channel on the attachment portion.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

Figures 1, 1A, 1B:
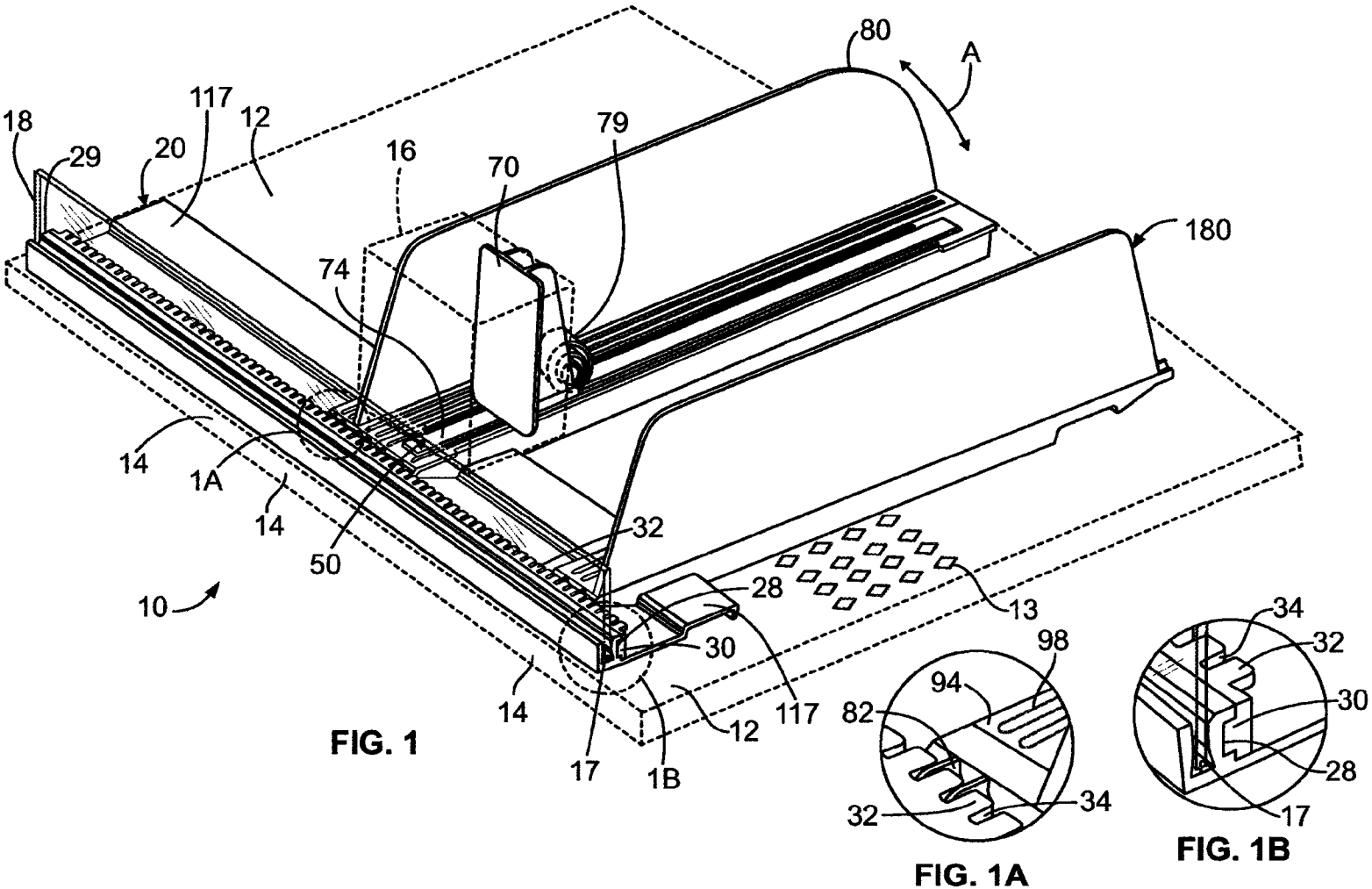
FIG. 1 illustrates a perspective assembly view of the inventive pusher merchandising system.
FIG. 1A illustrates a perspective detail view of the attachment of one portion of the pusher system to the forward shelf attachment portion.
FIG. 1B illustrates a perspective detail view of an end of the forward shelf attachment portion.
Figure 2:
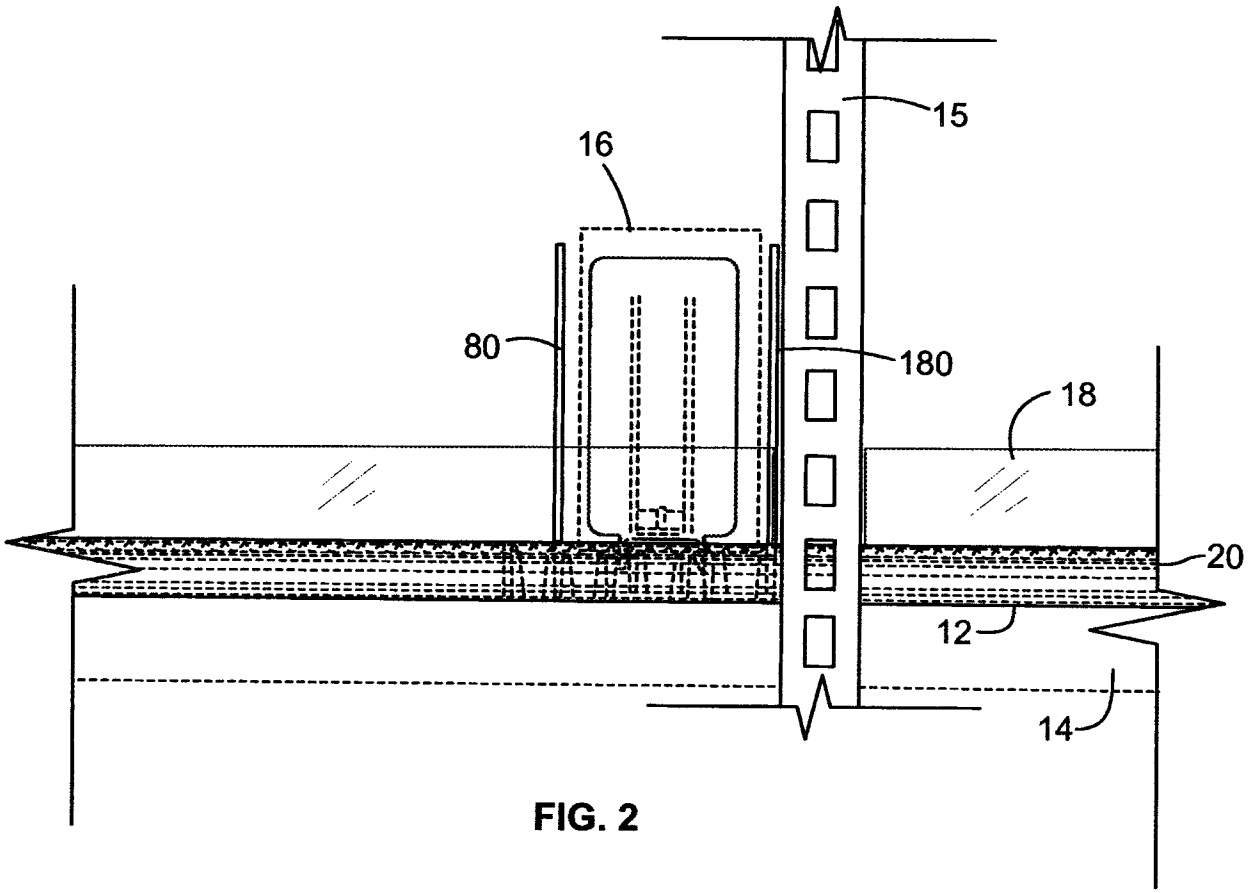
FIG. 2 is a front elevation view of the pusher system shown in FIG. 1.

Referring now to the assembly views of FIGS. 1 and 2, a merchandise display and pusher system 10 is illustrated as it would be attached to a longitudinally oriented shelf 12 (shown in phantom in FIG. 1). The pusher and display system 10 generally comprises a shelf attachment portion 20 configured to be attached to the shelf 12 by an appropriate means, such as adhesive, fasteners, magnetic strip, or other means, not shown. As shown, shelf 12 may have apertures 13 that provide for attachment of fasteners (not shown). Shelf 12 further comprises a forward edge 14 that is nearest the prospective customer when the customer is viewing the items at the point of purchase. A single item 16 is shown in phantom in the chute or track which is defined by the elements of system 10 for holding and displaying the merchandise items 16, and is illustrated only to show the orientation of the shelf relative to the system and the disposition of the items in the system 10.

Figure 3:
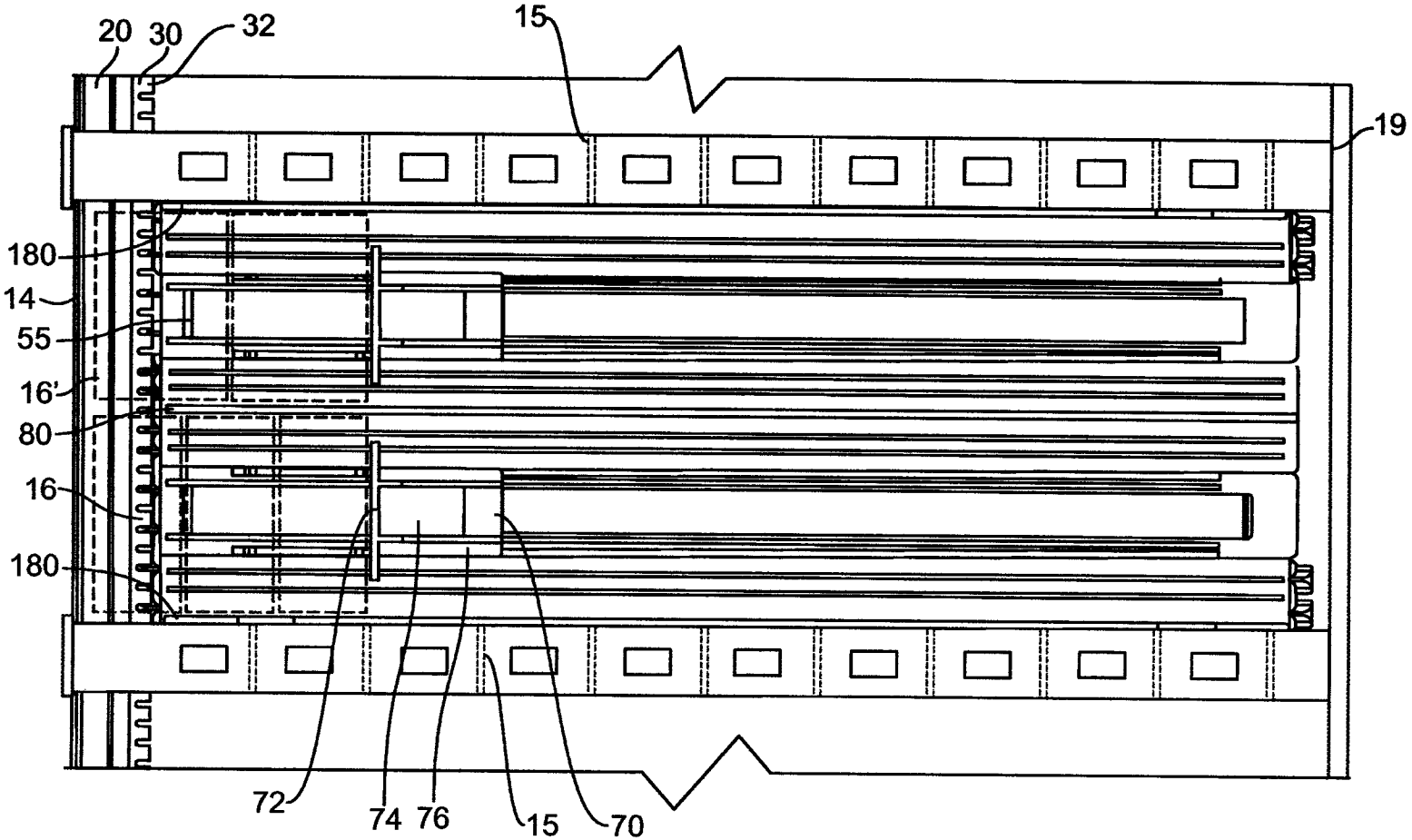
FIG. 3 is a partially cutaway top plan view of a compressed, modified pusher system as shown in FIG. 1, with only two chutes provided for ease in illustration.
Figure 4:
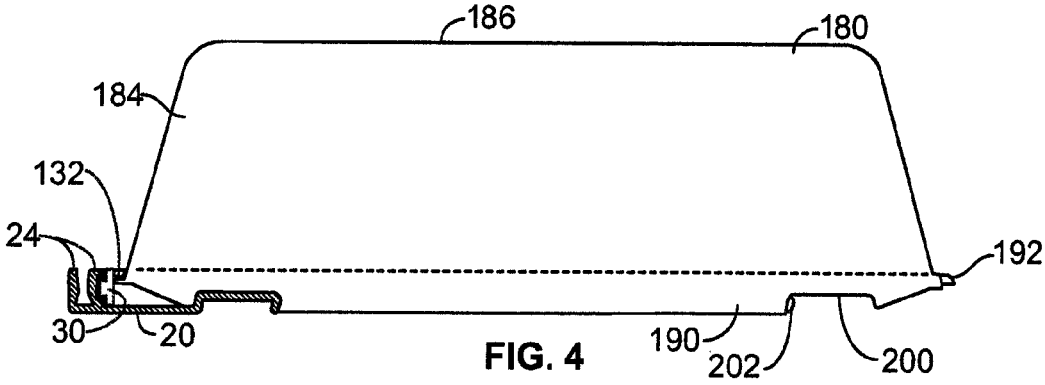
FIG. 4 is a side view of an end divider and illustrating a cross-sectional view of the shelf attachment portion of the pusher system shown in FIG. 1.

The perspective view of FIG. 1 and the front elevation view of FIG. 2 also show three other major portions comprising the inventive system 10, including several functional mechanisms, such as an elongated track portion 50 for supporting the items 16, and two different types of divider portions 80, 180. Additional drawing figures show these items in greater detail, but the assembly views of FIGS. 1-3 show the interrelationship of the portions and how they are arrayed on a shelf 12 and provide for display of items 16 (in phantom).

As can be seen in the drawing figures showing the separate portions, the features and elements provide an easy, efficient and economical means of displaying the merchandise in a display and pusher system 10 that is much easier to manufacture, assemble and use than heretofore known systems of like kind. Additionally, system 10 is aesthetically pleasing and easy to install and modify for different size products. Moreover, because of the modular parts, the use of the different parts at different positions on the shelf, for example, an end of shelf position, and the interchangeability of the parts make the present system a more flexible and easier to use one than heretofore known systems.

The merchandising and pusher system 10 is essentially comprised of four separate portions 20, 50, 80, 180, illustrated separately in FIGS. 8A-C, 10A-C, FIGS. 11A, 11B, 13A, 13B. In FIGS. 1 and 2, the system 10 is shown having the separate portions in an assembled state, as they would be configured when in operation on a shelf 12 (shown in phantom). These portions are the shelf attachment portion 20, a pusher track 50, a pusher 70, and divider portions 80, 180. The shelf attachment portion 20 is oriented to be parallel to the longitudinal dimension of shelf 12. The shelf attachment portion 20 further includes a price display holder 18 (shown in phantom) that also acts to retard the forward movement of items 16 beyond the edge of shelf 12 unless they are manually removed by, for example, a prospective purchaser. A retention mechanism 18, comprising clear plastic or other suitable material, inserted into a longitudinal slot 17, provides a stop so that the items 16 are not pushed off the shelf 12.

The pusher portion 50 and the divider portions in two different configurations 80, 180, as will be described in greater detail below, are all oriented to be essentially perpendicular to the longitudinal dimension of a shelf 12 on which items are displayed for sale. For ease in the following description, it should be understood that the designation of an end of shelf divider portion will be identified herein as 180, for purposes of completion, even if that divider portion is not shown at an end of shelf position. Where there are common or similar elements, the same numbers will be utilized, except that a value of 100 additional integers will be added to the identification numerals relating to the end dividers 180.

Referring now to the magnified detail views shown in FIGS. 1A and 1B, the connection or attachment mechanism of the pusher track 50 and divider portions 80, 180 to the shelf attachment portion 20, is illustrated. This mechanism comprises triangular teeth 32 extending in a direction parallel to the longitudinal direction of the shelf attachment portion 20, the teeth 32 defining slots 34 between the teeth 32. Slots 34 are arrayed along a tooth strip 30 in a manner capable of receiving oppositely oriented teeth on the end of one of the portions 50, 80, 180, as will be more fully described below. Tooth strip 30 may be insertable into a channel 28 disposed in an end section of shelf attachment portion 20.

The usual position of an end of shelf divider portion 180 is at a lateral end of a shelf 12 that ends in a bracket or wall 15 (FIG. 2). In the usual shelf configuration, brackets 15 extend vertically between the shelves and connect adjacent shelves 12 to each other. Each of the shelves 12 (in phantom) extend horizontally as viewed by a customer approaching the shelf 12 when interested in viewing a displayed item 16. The shelves may be dimensioned for different applications, but a standard length of a shelf 12 may be about 48 inches, center to center between the walls or brackets 15. The dimensions for the width of a shelf 12 will depend on the types of products being displayed, but may be anywhere from about 12 to about 30 inches. A configuration having about a 48 inch length permits for up to a maximum of 24 normally sized chutes, although more can be inserted in each shelf if a custom made system having narrower track and divider portions 50, 80 are provided. Generally, the number of chutes or tracks between divider portions is governed by the size, usually width, of the merchandising items 16 that are stacked up in a specific row, and as an average, the number of chutes or tracks are in a range of from 10 to 20 per shelf.

Each of the portions 50, 80 and 180 extend essentially laterally relative to the longitudinal direction of the shelf 12 and attachment portion 20. These portions 50, 80, 180 are attachable and detachable, as desired, from a predetermined lateral position on the shelf attachment portion 20. Their position is laterally adjustable to be in different relative positions along the longitudinal direction of the shelf attachment portion 20 to accommodate different size merchandising items 16, shown in phantom in FIGS. 1 and 2. As will be explained below, the lateral positions are adjustable by discreet, predetermined amounts that depend on the size of the triangular teeth 32 shown disposed on the shelf attachment portion 20.

In normal use, and as known in other similar types of known pusher systems, the dividers are spaced just slightly wider apart than the width of merchandise items in that row, so that the pusher 70 can easily propel the items down the chute defined by adjacent divider portions 80, or when disposed at an end of a section of a shelf 12, divider portions 80, 180. The system 10 includes several mechanisms, described below in greater detail, that maintain the dividers 80, 180 attached in an upright position, even in the absence of merchandise items in that chute or row, and that retain in a sturdy attachment to the shelf attachment portion 20, all of the divider portions 80 (and 180) and the track portion 50, as shown. At the appropriate time, when the types of merchandising items displayed are to be rearranged, the dividers 80 and the track portions 50 can be easily removed from the shelf attachment portion 20, by pivoting around the connection at the teeth 32 in the direction of the arrow A as shown, and moved laterally (longitudinally) along the front rail thereof, and reattached to the shelf attachment portion 20 at a desirable position to accommodate a specified width of a merchandise item.

Referring now to FIGS. 2 and 3 in conjunction, a front elevation and a top plan view, respectively are shown, of the pusher and display system after it has been installed on a shelf 12. In FIG. 3, to show schematically the use at opposite shelf ends of the end dividers 180, the longitudinal dimension of the shelf is shown as being very short, as only two rows of merchandise items between the shelf brackets or walls 15 are shown, which would not be the case for a normal store shelf. The compact configuration shown in FIG. 3 is for purposes of simplifying the illustrative example of use of the system 10.

The top plan view shown in FIG. 3 includes two tracks for holding and displaying merchandise, such as items 16, 16'. As shown, items 16, 16' etc, may be of different sizes and shapes, and the separation between the walls of the dividers 80, 180 may be adjusted by appropriately connecting the portions 50, 80, 180 to the position of the teeth 32 on tooth strip 30 that provides the width to accommodate the item 16, 16', etc. Two chutes for items 16, 16' are defined by the divider portions 80, 180, extending along with the walls 15 from the front edge 14 of the shelf to a back wall 19. The two end dividers 180 are in a usual position disposed adjacent to the shelf end walls 15, and have one surface either closely adjacent or flush to the surface of the shelf end wall 15. The planar continuation of the wall of the end divider portion 180, that is, with no teeth 82 on one side of the wall allows the disposition against the wall 15.

Figure 5:
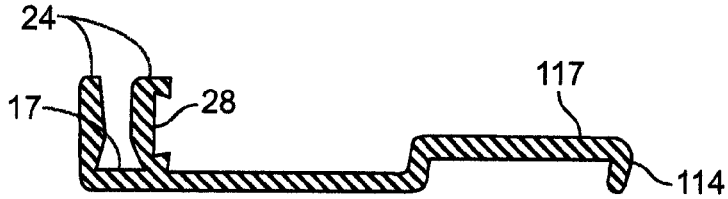
FIG. 5 is a side cross-sectional detail view illustrating the shelf attachment portion of the pusher system shown in FIG. 4.
Figure 10C:
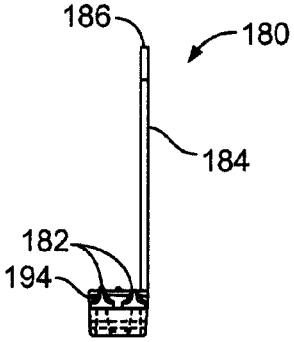
FIGS. 10A-10C illustrate an end of shelf divider portion in top, front elevation and side views, respectively.
Figure 10A:
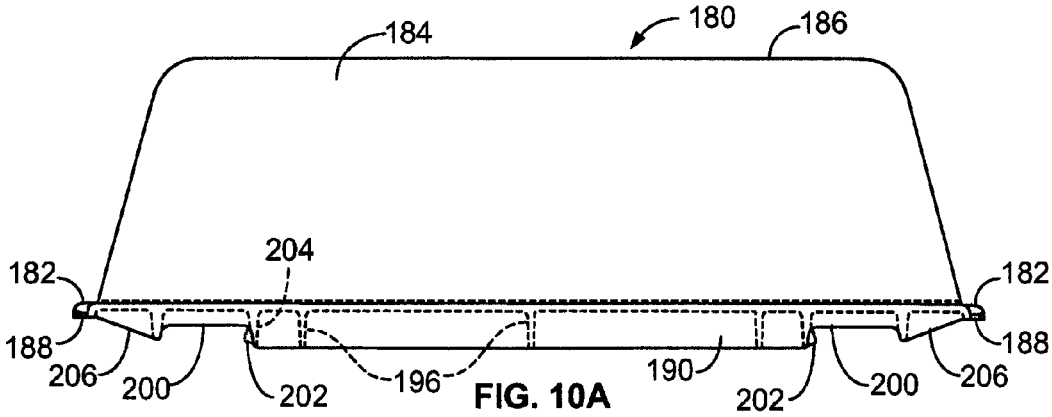
Figure 10B:
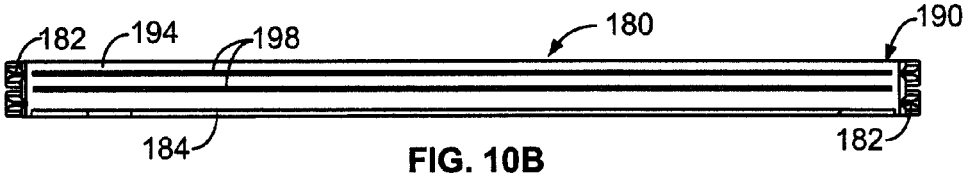

Referring now to the individual end divider portion 180 as shown in FIGS. 4, 10A, 10B, and 10 C, in conjunction with FIG. 5 showing a detail cross-sectional view of the attachment portion 20, one embodiment of the attachment mechanism will be described. FIGS. 10A-C illustrate respectively an elevation view, a top plan views and a side elevation view of an end divider portion 180. It essentially comprises a divider block 190, and upstanding wall 184 extending upwardly and away from divider block 190 to an edge 186, and two sets of attachment teeth 182 at the lateral ends of the divider block 190 for attachment to the attachment section (FIGS. 1 and 2). The divider block 190 includes one or more supporting ribs 196, shown in phantom in FIG. 10A, for providing rigidity to the divider block 190.

Divider block 190 provides a support for the items 16 (shown in phantom FIGS. 1-3), as they are retained in position on display before the prospective customer on a shelf and display system. Two cut-outs 200 between two adjacent ribs 196 at either end of the divider block 190 provide a portion of the attachment mechanism as will be explained with reference to FIG. 5. One or more special cantilevered tabs 204 ending in a button projecting outwardly into the cut-out 202 is attached to the underside of the divider block 190. Divider block 190 has a portion of the ends angled from the cut-out 202 in a short angled segment 206 extending between the cut-out and a projection 188 supporting the attachment teeth 182. The teeth are preferably plural and extend upwardly from projection 188 so that the apex of each tooth 182 is at the top and the bottom or base of the triangularly shaped teeth 182 is at the bottom and attached to the projection 188.

The divider block 190 includes only on one side of the divider upstanding wall 184 a horizontal surface 194 with at least one, and preferably two beads or tracks 198 as, shown, extending longitudinally and parallel to the wall 184 for the majority of the longitudinal dimension of the divider block 190. The tracks 198 comprise continuous small ridges that project upwardly from the surface 194 and provide a discrete contact to support the items 16. However, other types of supports may be used, for example, discontinuous ridges or bumps (not shown). At either end of the divider block 190, attachment portion projection 188 provides a second part of the attachment mechanism and, for the end divider 180, is provided at either end of divider block 190.

Figure 8C:
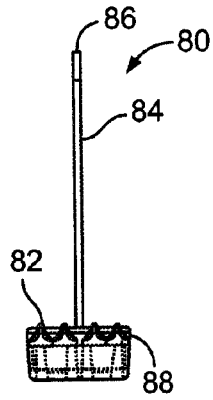
FIGS. 8A-8C illustrate a divider portion in top, front elevation and side views, respectively, the shelf divider being shaped and configured for installation to a middle of a shelf.
Figure 8A:
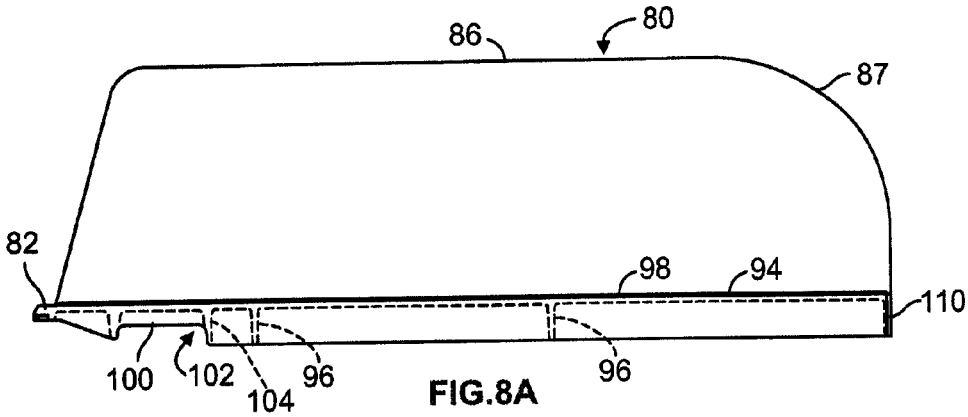
Figure 8B:
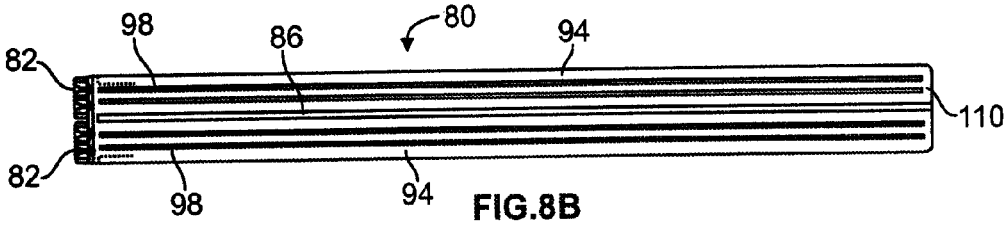
Figures 11A, 11B:
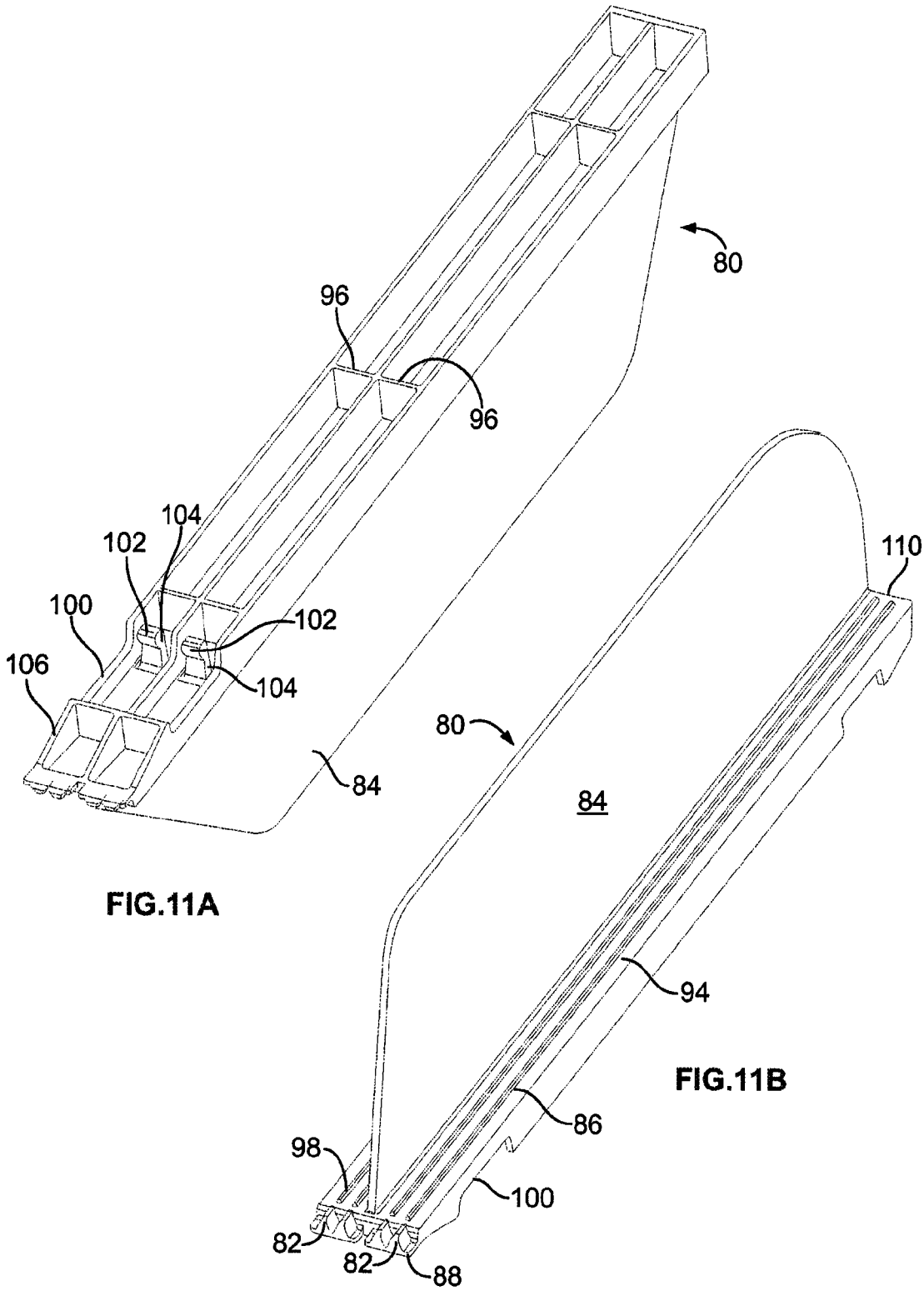
FIGS. 11A and 11B are top right and bottom left perspective views of the divider portion shown in FIGS. 10A-10C.

Referring now to FIGS. 1-3, 8A-C, 11A, 11B another type of divider 80 is illustrated, the divider 80 being configured and oriented for disposition in normal use at lateral points on the shelf 12 and along the attachment portion 20 intermediate the walls 15, as shown in FIGS. 1 and 3. The divider 80 has only a single orientation in that it need not be reversed to provide the ability to be adjacent a wall 15 because it is intended for disposition away form the walls 15. Thus, it need only have a single orientation of the projection 88 supporting the attachment teeth 182 in respect of its attachment to the attachment portion 20. The front attachment portion, including the projection 88 and teeth 82 of the divider 80 are very similar to the similar elements of the end divider 180 described above, and differs in two significant respects. First, as mentioned above, only one longitudinal end of the divider 80 includes the projection 88 and teeth 82. The second difference, as can be seen most clearly in FIGS. 8B, 8C and 11B, is that the divider block 90 includes an upwardly facing surface 94 on both sides of the divider wall 84, rather than on just one side, as in end divider 180.

The divider 80 includes a divider block 90 that extends on either side of the divider wall 84, and a surface 94 extends from the attachment sections at the front to the rear end 110 on either side of the divider wall 84. Unlike the end divider 180, the divider 80 has a plane of symmetry that extends through the divider wall 84, and all the elements on one side of wall 84 have identical elements on the other. As can be seen form FIGS. 1 and 3, each of the surfaces 94 provide support for items 16 being pushed forward in a different chute, and each of the divider block surfaces 94 cooperate with a second divider block surface 94 of another adjacent divider 80, 180 to provide the chute for the items to be supported thereby.

Each divider 80 includes the same elements, including the attachment elements and item support elements, except that in the divider 80, the elements are doubled and are disposed on one side of the common divider wall 84 are mirror images of the elements on the other side. These elements include cut-outs 100 across the bottom portion of divider block 90, short segment 106, two sets of teeth 82 one each on a projection 88, etc., all as shown in FIG. 11B. Illustrated in the perspective view of the underside of divider 80 in FIG. 11A, are the longitudinal ribs 95 being intersected at appropriate points by transversely extending lateral ribs 96. The distal end 110 of the divider, configured to be adjacent or in contact with the back wall 19 (FIG. 3) of the shelf, is a simple orthogonal terminal of the divider block 90, as shown.

Figure 9:
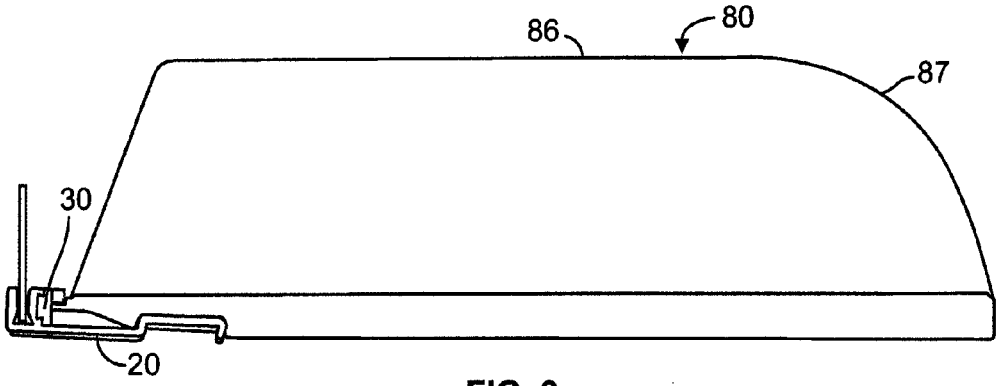
FIG. 9 illustrates a side view of the connection of the divider of FIGS. 8A-8C to a shelf attachment portion according to the present invention.

The connection or attachment mechanism comprising the teeth engagement part comprising projection 88 and teeth 82, and the plateau engagement part comprising the cut-out 100 and the pivotable tab 104 with raised knob 102 that engages an inset or flanged lip 114 (FIGS. 5 and 9) disposed at the rear of the attachment portion 20 provide for a secure attachment mechanism. Although described relative to the tab 104 and raised knob 102 of the divider 80, the attachment mechanism can also be considered to be applicable to the attachment mechanism for the end divider 180 and the pusher 50, which also include similar elements that attach these portions to the attachment mechanism 20. The discussion below should be viewed as also applying to these two portions as well, since their construction and operation are essentially identical.

The pivotable tab 104 is connected to the underside of divider block 90, preferably integrally by means of the desired injection molded configuration. The connection is made at a discrete point at one end of tab 104, the other end comprising the raised knob 102 that projects into the slot provided by cut-out 100 in a natural rest position of the knob 102 (best seen in FIGS. 8A and 10A). The knob 102 can be pushed inwardly into the enclosure of divider block 90 by pivoting the tab 104 toward the right as seen in FIGS. 8A and 10A, but the resiliency of the tab 104 will push the knob 102 back to the natural rest position. Thus, the knob 102 will act as stop if it is engaged with the flanged lip 114, and engagement therewith will retain the engagement of the cut-out 100 with the plateau 112.

As can be seen from the perspective view of FIG. 11B, the teeth 82 extending outwardly from the connecting members are triangular, to engage the corresponding triangular teeth 32 of the tooth strip 30. The tooth strip 30 has a base 34 that fits within a channel 28 in the front wall 24 of the shelf attachment portion 20, as is shown in the assembly drawing of FIG. 1.

The shape and dimensions of the cut-out 100 essentially correspond to the shape and dimensions of the plateau 112 of the attachment portion 20, so that when the two are engaged, the cut-out 100 surrounds and provides a close interference fit with the plateau 112. The method of attachment comprises first engaging the teeth 82 of the divider 80 to teeth 32 of the attachment portion 20, with the divider block 90 of the divider 80 being at an angle relative to the plateau 112. Once positioned in the proper lateral position along strip 30, the block of the divider 80 is pivoted about the point of connection of teeth 32, 82 until the cut-out 100 is engaged completely with the plateau 112. To complete the engagement, the knob 104 must be depressed by action of the lip 114 at the end of the plateau 112, pivoting slightly away from the cut-out 100 until it clears the end of lip 114, after which the resilient nature of the tab 104 cause the tab and knob 102 to snap into the rest position. When the raised knob 102 returns to its rest position knob 102 engages the lip 114, and the engagement is complete. Once engaged, the teeth lock in place so as to inhibit lateral motion of the divider 80, or any other of the portions 50, 180 that are so engaged. The knob 102 also locks the vertical position of the divider block 90 relative to the plateau 112, so that the divider is locked until it need to be removed or displaces along the strip to accommodate different sized items 16, 16' (FIGS. 1-3). When the divider 80 needs to be removed, the back end 110 of divider block 90 is pivoted upwardly, thereby disengaging the teeth 82 from teeth 32. Following teeth disengagement, the divider block 90 and the divider 80 are free to move either laterally along the strip 30 or to be withdrawn completely from the particular shelf 12 and transferred to storage or to another shelf where it can be utilized again.

Figure 6A:
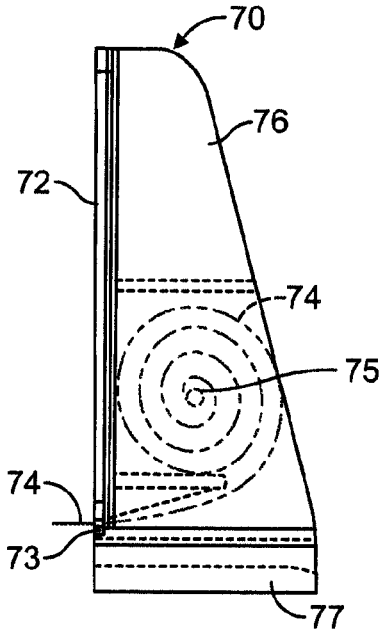
FIGS. 6A and 6B illustrate in a side view and a back elevation view, respectively, a pusher according to the present invention.
Figure 6B:
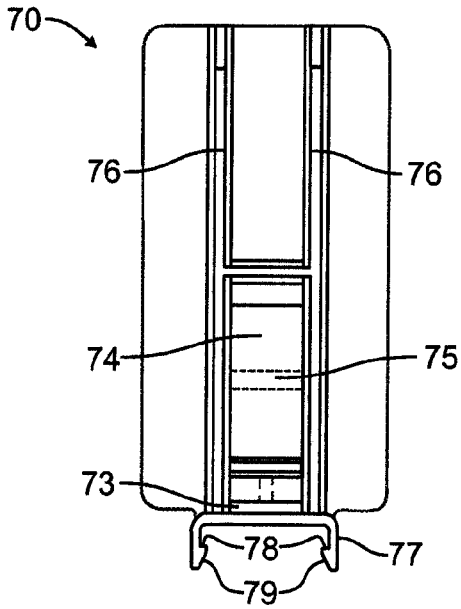
Figure 13A:
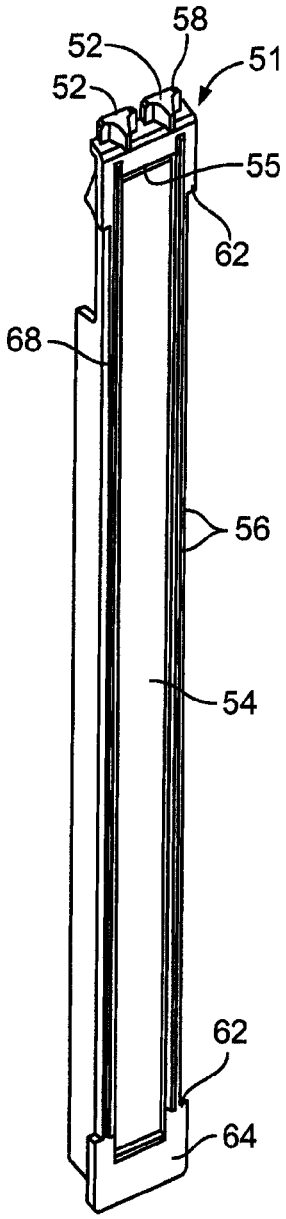
FIGS. 13A and 13B are top right and bottom left perspective views of the track portion.
Figure 13B:
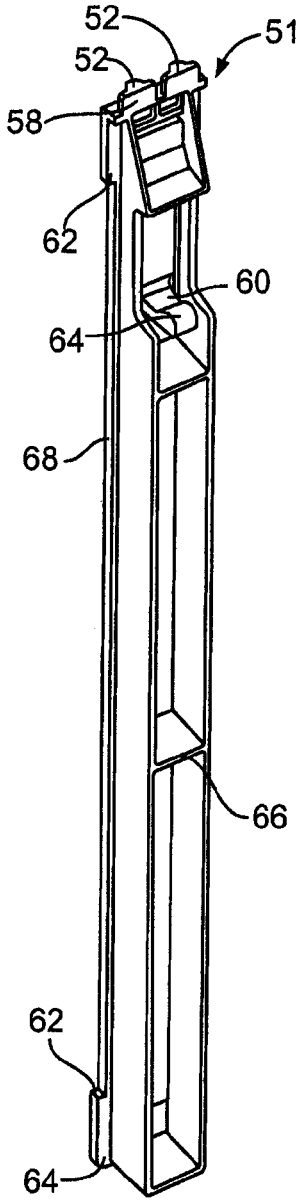

Referring now to FIGS. 6A and 6B, in conjunction with FIGS. 13A and 13B, the pusher assembly portion 50 will be described. Pusher assembly 50, as shown in the assembled condition in FIGS. 1-3, comprises a track section 51 upon which a pusher 70 is slidably attached. The pusher 70 includes a coil spring or other appropriate mechanism 74 that biases the pusher 70 toward the desired direction, that is, toward the front 14 of shelf 12, as shown in FIG. 1, when the system 10 is installed on a shelf.

The pusher track section 51 comprises a block with a proximal end and an attachment mechanism, the elements being very similar to those of block 90 of the divider 80, having a cut-out 67 for engaging the plateau 117 (FIG. 1) and teeth 52 to engage the corresponding teeth 32 of the attachment section 20. The block includes a track having an upwardly facing surface 54 with two beads 68 for supporting the items, together with the similar beads or tracks 98, 198 of the divider sections 80, 180, respectively. The track surface 54 further extends laterally along the longitudinal edges to provide one cantilevered extension for capturing the bayonet or fishhook clips 79 (as viewed in profile in FIG. 6B) of the pusher 70.

At the distal end of track 51, a stop element 64, including the further lateral extension of the cantilevered longitudinal edge extensions, define two stops 63 that prevent the pusher from being pushed beyond a point which would disengage it from the track surface 54. Similar stops 62 are present at the proximal end which prevent the pusher 70 from being pulled off of the front or proximal end that will be disposed along the shelf front edge when in operation.

At the proximal end, there is provided an attachment mechanism for attaching the track portion 50 to the attachment section 20, similar to those described above in reference to dividers 80, 180. Triangularly shaped teeth 52 are at the very end of the distal end and extending vertically from a projection 58, are oriented with an apex as shown that is adjacent the surface 54, the base of the triangular teeth 52 being disposed below that surface.

The spacing between teeth 52 must correspond to the spacing between the oppositely disposed teeth 32 of the attachment portion 20 to accommodate the engagement therebetween. However, unlike teeth 82 of the divider portion 80, teeth 52 do not have a one to one correspondence with the spacing of the teeth 32. The separation in the teeth 52 provides for an omitted gap 34 between the teeth 32 that does not have an engagement tooth 52 corresponding thereto, but the spacing should be sufficient to correspond to the second gap over in order to provide an engagement position. The spacing between teeth may be varied, and more that in two teeth may be utilized for engagement of the portions 50, 80, 180. However, as can be appreciated, at least two teeth are needed to provide a non-pivoting engagement, and a separation between teeth 52 as shown in FIGS. 13A and 13B may be preferable for providing a greater base separation to prevent pivoting around the attachment point, thereby maintaining the position and orientation of the portions 50, 80, 180 relative to the attachment portion 20.

Referring now more particularly to FIGS. 6A and 6B, the pusher 70 will be described in greater detail. FIG. 6A shows the pusher 70 in profile and FIG. 6B shows a rear elevation view thereof. The pusher face 72 provides direct contact with the items that are being pushed along in the chute defined by the dividers 80, 180, and it is oriented toward the proximal end of the pusher track 51 when the system is operational, so that the face pushes items toward the shelf edge 14.

Pusher 70 further comprises a base 77 for providing a slidable connection to the track 51, pusher face 72 extending upwardly from the base 77. The base is a longitudinal enclosure tubularly or U-shaped with an opening that is downwardly directed in a direction away from the face 72. The two side walls 79 of the base 77 are separated by a distance that is slightly larger than that of the width of the track surface 54, including the extensions 68, so that the walls can be disposed on either side of the base of the pusher track 51. Base walls 79 in profile view of FIG. 6B are shown as including a bayonet or fish hook shape that provides a stop surface 78. When inserted over the surface 54 and depressed thereunto, the two walls 79 separate slightly until the base 77 is seated in relation to the track base. As soon as surfaces 78 clear the thickness of the extensions 68 of the track base and the walls 79 revert to their normal downwardly directed position, the base 77 is then captured by the extensions 68 which extend across the inner dimension of the base 77. The extensions are just wide enough to be captured by the surfaces so that the base can no longer be pulled up off the surface 54, but the fit is not tight, so that the base 77 is slidable along the track 51 in the longitudinal direction. The dimensions of the base 77 are wide enough that they provide a steady orientation of the face 72 while being slidable in relation to the surface 54.

Supporting the pusher face 72 are two spaced apart ribs 76 that are perpendicular to the length dimension of base 77 and are also essentially perpendicular to the face 72. The face 72 and ribs 76 define a semi-enclosed space for retaining a coil spring 74 mounted for rotation on an axis 75 that extends between the upstanding ribs 76. The face 72 includes a slot 73, adjacent the base 77, through which one extending end of the coil spring 74 extends forwardly of the face 72, as shown in FIG. 6A. The coil spring 74 is free to unspool through the slot 73, but as it is unpooled, the coil spring begins to develop tension. The extending end of the coil spring 74 is attached to a point at the proximal end of track 51, shown as a slot 55, which fixes that end of the coil spring. Thus, as the pusher 70 is slid along the face 54 in a direction away from the proximal end and slot 55, the coil spring 74 unwinds and begins to provide tension, thereby biasing the pusher 70 toward the proximal end of the track 51. The tension of course is decreased as the pusher nears the proximal end of the track 51, as the items 16 are removed from shelf 12 by customers. The coil spring 74 is long enough that the tension provided is not so great as to impede the insertion or removal of the items.

Figure 7:
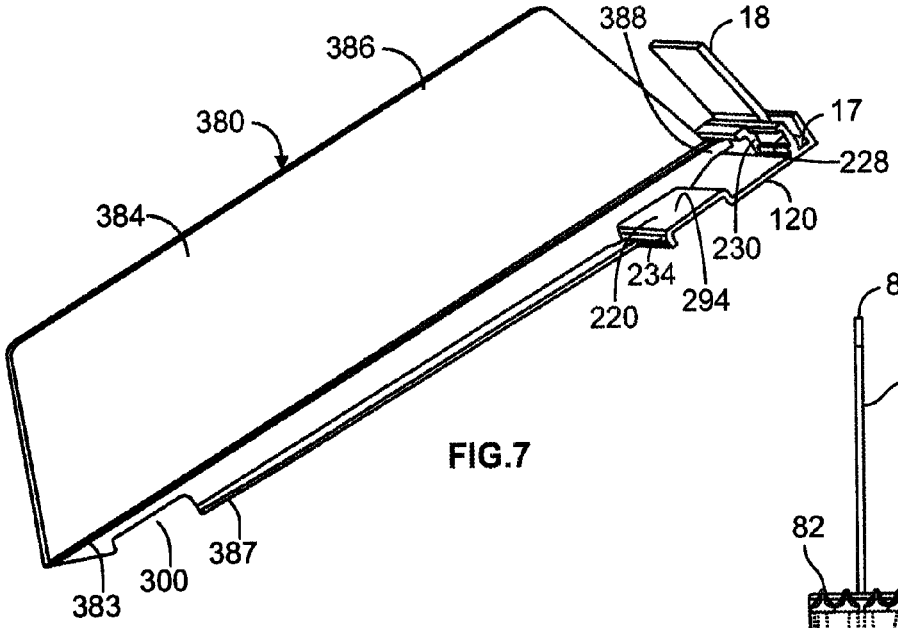
FIG. 7 is an alternative embodiment of the connection of the divider portion to a shelf attachment portion.

Another embodiment of the invention is shown in FIG. 7, where the width of the dividers 380 are required to be very short in order to accommodate items 16 of small size. For the dividers 380, the wall 384 extends below the level of the side support, which may comprise a simple bead 383 as shown. The support function for this embodiment will be provided mostly by the surface 54 of the pusher portions 50 intervening between adjacent dividers 380. The base of divider 380 is provided rigidity by a laterally extending support 387, which also acts to attach the divider 380 to the attachment portion 20, or alternative embodiment 120 shown in FIG. 7.

The attached condition of the end divider portion 380 showing its attachment to the attachment portion 120 will be described in greater detail with reference to FIG. 7. Although not a preferred configuration, it can also illustrate some of the features discussed in with respect to another of the embodiments of the present invention. As is shown, there are no teeth in the embodiment, the attachment simply being one of an interference fit between the projection 388 and a horizontally extending member of the attachment strip 230. The attachment of the cut-out 300 in the base of divider 380 to the plateau section 294 can be facilitated by a bead 234 extending along the back wall of the plateau section 294.

Figure 14:
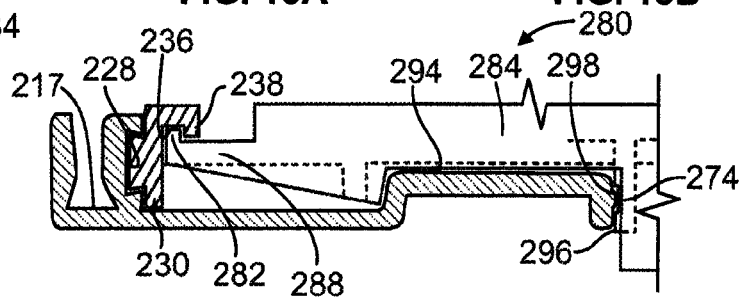
FIG. 14 is a detail of an alternative embodiment of the attachment mechanism at the proximal end of the portions attached to the attachment portion.

Still another embodiment of the attachment mechanism is show in the detail view of FIG. 14, which has a bead 274 similar to the bead 234 shown in FIG. 7. In most respects, the attachment section 220 shown in FIG. 14 is similar to that of the one in FIG. 7. It also differs from the attachment section 20 in that it does not have an angled wall, but instead relies on the bead 274 to capture or engage with a detent 298 in a pin 296 that extends form the bottom of the base of the divider 280. A wall 284 of divider 280 obscures somewhat the operation of the pin 296, but pin 296 is also pivotable about its connection to the base of the divider 280. When the base is depressed to engage the plateau surface 294, the pin 296 pivots because of the pressure of the bead 274. After it clears the bead 274, the detent 298 then receives the bead 274 and locks the divider portion 380 in place.

Another significant difference in the alternative attachment mechanism shown in FIG. 14 is an interference fit of the front or proximal end of the divider 280 to an attachment strip 230. The attachment does not have any teeth as in the other embodiments, but relies on the dimensions of the upturned flange 282 with a channel 228 in the strip 230 to inhibit lateral motion of the divider 280 when the divider 280 is attached. Strip 230 includes an overhanging cantilevered ridge 238 that forms a channel 236. The sizings of the channel 236 and of the flange 282 are such as to cause an interference fit when the flange 282 is wedged into the channel 236. Together with the attachment to the plateau 294, the divider is then locked in place until the engagement of the bead 274 with the detent 298 is broken.

Other modifications can be instituted in the attachment portion 20. Whereas the strip is shown as being removable in a preferred embodiment by sliding it out of a channel 228, the cantilevered ridge and strip 230 may be made integral with the front wall of attachment portion 20. Other alterations are possible, for example, the size of the pusher 70 may be made smaller or larger to accommodate different sized items 16.

Figure 12A:
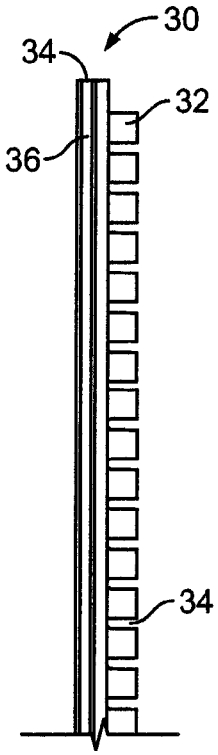
FIGS. 12A-12B illustrate a tooth strip according to the present invention in top plan and side elevation views, respectively.
Figure 12B:
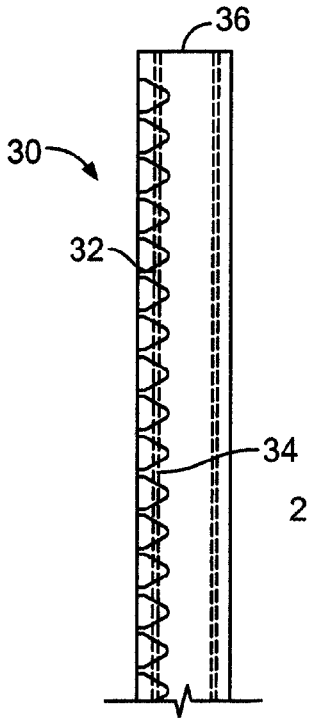

Referring now to FIGS. 12 A and 12B, the removable strip 30 is shown as a separate element. It includes a dovetail section 36 that slidably engages a similarly shaped channel 28 (similar to that channel 228 in FIG. 14). Teeth 32 are separated by gaps 34, and the spacing of the teeth 32 conforms to the spacing of the opposed teeth of the corresponding portions 50, 80, etc. The triangular shape of teeth 32 is shown, and the included angle of the apex corresponds to like angles in the opposed teeth to provide a sturdy and robust engagement between the teeth when the portions 50, 80 etc. are attached to the attachment portion 20.

The feature of inserting the strip 30 as a slidable element into channel 28 is desirable in that it provides for a more efficient and less expensive method of manufacture of the system 10. The teeth are anomalous in the production of the attachment portion, since they are not uniform in shape and must be manufactured using an injection molded process. However, the remainder of the attachment portions besides the teeth strip 30 is uniform when viewed, for example, from the side or as a cross-section shown in FIG. 5. Thus the major part of the attachment section 20 may be manufactured by a continuous extrusion process, thereby foregoing the need to injection mold that part as a separate element for each portion. Thus, the injection molding of the attachment portion may be limited to the teeth strips 30, thereby improving efficiency and reducing costs.

Another feature that adds to the efficiency of the system becomes apparent when viewing the shelf end divider 180 that is meant to be disposed at an end of shelf position. The use of an end of shelf position divider 180 provides two benefits, first using all the shelf space because of the ability to dispose the divider wall 184 against the shelf supports 15, because one part of the block or base 190 is removed in divider 180, and the divider wall 184 is contiguous with the outer surface of the base 190, the divider wall can be disposed immediately adjacent a shelf wall or bracket 15, as shown in FIG. 2. In addition, the end of shelf divider has both a set of connection teeth 190 at either longitudinal end of the block 184, so that divider portion 180 can be used at either a left side wall or a to a right side wall, simply by removing it and rotating it around to attach the other teeth 182 to the shelf attachment portion 20. In this way, only one set of end dividers need be provided in the system 10, since dividers 180 would be utilizable at each of the two right and left end of shelf positions without further modification.

The invention herein has been described and illustrated with reference to the embodiments of FIGS. 1 through 13 B, but it should be understood that the positive locking and other features of the invention are susceptible to modification, alteration, change or substitution without departing significantly from the spirit of the invention. For example, the dimensions, size and shape of the various elements may be altered to fit specific applications. Similarly, the while more than one embodiment is shown, there is sufficient disclosure so that a person of ordinary skill can use the disclosure to provide the benefits of the invention. Accordingly, the specific embodiments illustrated and described herein are for illustrative purposes only and the invention is not limited except by the following claims.

What is claimed is:

1. A pusher merchandising system adapted to be attached to a shelf having a shelf surface and front shelf edge for displaying merchandise items at the front shelf comprising:

a) a shelf attachment portion that is shaped and configured to attach to a forward edge of a merchandise shelf, the forward edge being adjacent the front shelf edge, the shelf attachment portion including a base extending essentially in a plane defined by a first direction being essentially parallel to the shelf surface and essentially perpendicularly to the front shelf edge and by a second direction extending essentially perpendicularly to the shelf surface when the shelf attachment portion is attached to the shelf for operation, the base having a front attachment wall extending essentially vertically from a lower portion adjacent the plane of the base being configured to be disposed at a front edge of said base that is disposed closest to the forward edge of the shelf when the shelf attachment portion is attached to the shelf and an upper portion disposed distal from the shelf surface, the front attachment wall including plural triangularly shaped base engagement teeth protruding essentially horizontally only from the upper portion of said front attachment wall in the first direction, an intermediate base section of the base connected to the front attachment wall, an upraised plateau removed from the vertically extending front attachment wall and extending and being upraised essentially in the second direction and raised above the intermediate base section, the upraised plateau being disposed opposite the end of the intermediate base section from said front attachment wall;

b) a divider portion having a proximal end and a distal end, the divider portion including a divider block at an end thereof, at least one divider portion surface extending horizontally substantially between the proximal and distal ends of the divider portion, an essentially planar divider extending outwardly from the divider block essentially perpendicularly to the divider portion surface and an attachment means disposed at said proximal end adapted for connection to said shelf attachment portion;

c) an elongate pusher track, the pusher track having a longitudinally extending base, a proximal end and a distal end defining a track direction, at least one pusher surface extending substantially between the proximal and distal ends, the pusher surface extending laterally beyond the base thereby defining a cantilevered extension at each lateral edge of the pusher surface, and an attachment means disposed at said proximal end adapted for connection to said attachment portion; and d) a pusher member having a connecting base and a facing pushing surface extending therefrom, the connecting base including a pusher base connection mechanism for cooperation with the cantilevered extension of said pusher track to maintain the pushing face oriented in a direction essentially perpendicular to the track direction and providing a bias in the direction toward the connecting base, wherein the attachment means of the elongate pusher track comprises at least one track tooth and further wherein both the plural triangularly shaped base engagement teeth and the at least one track tooth have a triangular profile such that when the triangularly shaped base engagement teeth and the at least one track tooth engage each other, the apex of the triangularly shaped base engagement teeth is closest to the base of the at least one track tooth and the apex of the at least one track tooth is closest to the base of the triangularly shaped base engagement teeth, and wherein the plural triangularly shaped base engagement teeth are positioned and oriented relative to the attachment wall to have the apex of the triangularly shaped base engagement teeth lowermost and the base of the triangularly shaped base engagement teeth uppermost when in position to engage the at least one track tooth, and wherein the apex of the triangularly shaped base engagement teeth is disposed above the intermediate base section and the upraised plateau.

2. The pusher merchandising system of claim 1 wherein the base engagement teeth extend in a third direction, that is essentially opposite from the second direction.

3. The pusher merchandising system of claim 1 wherein the attachment means of the divider portion further comprises at least two divider attachment teeth disposed at a longitudinal proximal end of the divider block, the divider attachment teeth being connected to and extending only horizontally from the longitudinal proximal end and being shaped and dimensioned to provide engagement between the divider attachment teeth and the base engagement teeth.

4. The pusher merchandising system of 1, wherein an end of shelf divider that is configured to be disposed at a lateral end of shelf position includes a divider block having an end wall to be disposed adjacent a shelf lateral end and a divider having a generally planar surface that is adapted to be disposed flush with the shelf end wall of a shelf support wall.

5. The pusher merchandising system of claim 3, wherein an end of shelf divider configured to be disposed at an end of shelf position includes a divider block having an end wall to be disposed adjacent a shelf end and a divider having a generally planar surface that is adapted to be disposed flush with the shelf end wall of a shelf support wall.

6. The pusher merchandising system of claim 1 wherein the front attachment wall disposed at a front edge of said base includes a longitudinal channel extending along the attachment wall upper portion in a direction parallel to the front edge of the shelf, when the system is installed and operational, the channel being shaped and configured to retain within it a tooth strip, the tooth strip including the plural of triangularly shaped base engagement teeth protruding only essentially horizontally in a perpendicular direction away from the tooth strip, such that when the tooth strip is inserted into the longitudinal channel, the base engagement teeth protruding therefrom are shaped configured and oriented to receive and engage with the corresponding attachment means disposed on the proximal end of a divider or track portion.

7. The pusher merchandising system of claim 6 wherein both the longitudinal channel and a tooth strip base, from which said triangularly shaped base engagement teeth protrude, are essentially in the shape of a dovetail when viewed in cross-section.

8. The pusher merchandising system of claim 1 wherein the pusher base connection mechanism further comprises two lateral cantilevered locking arms shaped and dimensioned so that one pair of each of the locking arms engage in a pincer configuration on each lateral edge of the track surface.

9. The pusher merchandising system of claim 8 wherein the upraised plateau further comprises a configuration and orientation that projects upwardly to extend above the height of the intermediate base section to a height dimension that is less than one half of the height of the base front attachment wall, and the base engagement teeth are disposed in a part of the front attachment wall that extends above the plateau in relation to the intermediate base section.

10. The pusher merchandising system of claim 1 wherein the pusher surface extends longitudinally beyond the base of the elongate pusher track at least at one longitudinal end, thereby defining a cantilevered tooth extension at least at one longitudinal end of the pusher surface, the at least one track tooth projecting outwardly from the cantilevered tooth extension.

11. The pusher merchandising system of claim 9 wherein the upraised plateau is shaped, positioned and oriented to facilitate attachment to the track, the track including a cut-out disposed in the bottom surface thereof at a point intermediate between two longitudinal ends.

* * * * *